United States Patent [19]

Emmenegger

[11] Patent Number: 4,980,035

[45] Date of Patent: Dec. 25, 1990

[54] BATH FOR ELECTROLYTIC DEPOSITION OF A GOLD-COPPER-ZINC ALLOY

[75] Inventor: Heinz Emmenegger, La Chaux-de-Fonds, Switzerland

[73] Assignee: Engelhard Corporation, Edison, N.J.

[21] Appl. No.: 382,011

[22] Filed: Jul. 17, 1989

Related U.S. Application Data

[63] Continuation of Ser. No. 233,704, Aug. 18, 1988, abandoned.

[30] Foreign Application Priority Data

Aug. 21, 1987 [CH] Switzerland ..... 3226/86

[51] Int. Cl.[5] ..... C25D 3/62

[52] U.S. Cl. ..... 204/44

[58] Field of Search ..... 204/44

[56] References Cited

U.S. PATENT DOCUMENTS 4,358,351 11/1982 Degussa .

4,687,557 8/1987 Emmenegger ..... 204/44

FOREIGN PATENT DOCUMENTS 0041208 12/1981 European Pat. Off. .

0193848 9/1986 European Pat. Off. .

2353656 12/1977 France .

2151661 7/1985 United Kingdom .

*Primary Examiner*—G. L. Kaplan

[57] ABSTRACT

The bath for electrolytic deposition of an Au-Cu-Zn alloy contains cyanide complexes of Au, of Cu and of Zn, a surface-active agent and a soluble Te and/or Bi salt. It may also contain a non-cyanide organic Zn complex, and a conductive salt and/or alkali metal or ammonium cyanide.

12 Claims, No Drawings

BATH FOR ELECTROLYTIC DEPOSITION OF A GOLD-COPPER-ZINC ALLOY

This is a continuation of copending application Ser. No. 07/233,704 filed on Aug. 18, 1988, abandoned.

The present invention relates to a bath permitting the electrolytic deposition of a gold-copper-zinc alloy and to its use in electroplating. Until now, little research has led to the deposition of an alloy of this kind, in contrast to the gold-copper-cadmium deposits which have formed the subject of very many publications, but which are gradually being abandoned because of the prohibition on the use of cadmium in certain countries because of the toxicity of this metal. In fact, zinc is much more difficult than cadmium to deposit together with gold and copper and, furthermore, the electrolysis conditions are completely different when changing from one of these alloys to the other.

Swiss Patent CH No. 286,123 refers to the possibility of depositing zinc at the same time as gold and copper, by means of a bath called a "blue bath" because of its colour, due to the presence of $Cu^{2+}$ ions. The deposits which it permits to obtain exhibit great fragility and high internal stresses which must be removed by a costly heat treatment. In addition, this bath gives only pink deposits, which are easily attacked by nitric acid and which therefore offer a mediocre corrosion resistance.

U.S. Pat. No. 4,358,351, corresponding to Patent Application EP No. 0,041,208 also involves the codeposition of zinc with gold and copper, but it, too, leads to deposits of nonuniform texture which, although yellow or pink, are also attacked by dilute nitric acid. Because of this, this method cannot be reliably employed on an industrial scale in practice.

Lastly, Patent Applications DE-OS No. 3,345,794 and DE-OS No. 3,345,795 also relate to the deposition of a gold-copper-zinc alloy, but exhibit the same disadvantages as the above baths.

It may be concluded, therefore, that, in the present state of the art, there is no commercially exploitable bath in existence making it possible to obtain by electroplating on an industrial scale and in a satisfactory manner a gold-copper-zinc alloy deposit which is pink or yellow, bright and, above all, with uniform crystallization (crystalline "texture") which resists corrosion, and more particularly the nitric acid test. This test is commonly carried out to determine the thickness and the gold content of the deposit (ISO standards 4524/1 and 4524/4), this being done particularly in order to confirm the description "gold plated" of a deposit of gold alloy.

The aim of this invention consists, therefore, in providing a bath which exhibits the abovementioned qualities. The bath for electrolytic deposition of a gold-copper-zinc alloy, forming the subject-matter of the present invention and intended to attain the abovementioned aim, contains cyanide complexes of gold, of copper and of zinc respectively, at least one surface-active agent, and at least one soluble tellurium and/or bismuth salt. According to one embodiment, the zinc may also be present in the form of a non-cyanide organic complex or of a salt of an acid (e.g. an acid salt).

The bath according to the invention may additionally contain a conductive salt, a depolarizing agent, an alkali metal or ammonium cyanide, and/or an amino or aminocarboxylic acid.

The bath according to the invention preferably contains the various components in the following respective ranges of concentrations:

- from 0.5 to 20 g/l of gold in the form of cyanide complex
- from 0.1 to 30 g/l of copper in the form of cyanide complex
- from 0.1 to 50 g/l of zinc in the form of cyanide complex
- from 1 to 100 mg/l of Te and/or of Bi in the form of a soluble salt ($Te^{+4}$, $Bi^{+3}$) (from 200 to 2,000 mg/l if the Te is in hexavalent form)
- from 0.1 to 20 ml/l of surface-active agents
- from 0 to 50 g/l of zinc in the form of an organic complex other than cyanide or of a salt of an acid
- from 0 to 10 g/l of depolarizing agent
- from 0 to 100 g/l of conductive salts, and
- from 0 to 10 g/l of alkali metal or ammonium cyanide.

The pH of the bath is preferably between the values of 7 to 12.

The colour of the Au/Cu/Zn alloy deposit obtained with the electrolytic bath according to the invention is independent of the current density applied during the electrolysis. It is, in fact, only a function of the copper content of the said bath. Thus, according to a first alternative form, a yellow-coloured deposit of Au-Cu-Zn alloy is obtained from a bath containing, for example, 4 g/l of gold, 3.5 g/l of copper and 10 g/l of zinc. On the other hand, according to a second alternative form, it will be possible to obtain a pink-coloured deposit with a bath containing a larger quantity of copper, namely 17 g/l, with the same quantity of the other two metals.

The soluble Te and/or Bi salt employed in the bath according to the invention is preferably an alkali metal, ammonium or amine salt, more particularly one whose anion is capable of promoting the crystallization of the electroplating deposit, or else a complex salt with carboxylic acids, amino acids, aminocarboxylic acids, and the like. The soluble Te and/or Bi salt may be introduced by itself or mixed with inorganic or optionally organic brightening agents.

As mentioned above, a part of the zinc may be introduced into the bath in the form of a non-cyanide organic complex, for example with amino, aminocarboxylic, hydroxyalkylaminocarboxylic, polyaminocarboxylic or hydroxyalkylpolyaminocarboxylic acids, or else of a salt of acids such as hydroxymethyliminodiacetic, nitrilotriacetic (NTA), hydroxyethyliminodiacetic, hydroxypropyliminodiacetic, hydroxybutyliminodiacetic, oxycarbonylethylaminodiacetic, N,N-bis(carboxymethyl)aspartic, aspartic, glutamic iminodiacetic and picolinic acids, or else amino acids such as alanine, glycine, glycylalanine, asparagine, glycylglycine, histidine, leucine, methionine, phenylalanine and valine. All these compounds are preferably employed in the form of soluble salts, for example sodium, potassium, ammonium or amine salts. The complexes with glutamic, aspartic and aminodiacetic acids are preferred.

As a surface-active or wetting agent it is possible to employ, in isolation or in combinations, commercially available products known by the name of nonionic, anionic, cationic or amphoteric surfactants. In particular, amidopropyldimethylamino oxides of fatty acids, dimethylamino oxides of saturated fatty acids, dimethylalkylamino oxides and bis(2-hydroxyethyl)alkylamino oxides, and the like, may be advantageously employed. It is also possible to advantageously employ as a wetting agent an amidoaminopropionate derivative in the form of the ampholyte ion (zwitterion) having the following formula

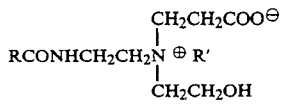

where R is a $C_8$ to $C_{20}$ alkyl group and R' is a hydrogen atom or a —$CH_2COOH$ residue. These derivatives are known particularly by the name of amphopropionates; by way of examples there may be mentioned the cocoamphopropionate and cocoamphocarboxypropionate, which are marketed under the trademark "Miranol".

The bath according to the invention may also contain depolarizing agents. These are compounds which act on the anodes to make them operate uniformly. The latter, of insoluble type, are generally made of stainless steel. Since, during the electrolysis, they form the seat of an oxidation, unless precautions are taken they can become coated with a film of oxides restricting the flow of the current and capable of causing disturbances. This oxidation can take place at the expense of the cyanide complex $Cu(CN)_3^{-2}$, which is destroyed with appearance of $Cu^{+2}$ ions which colour the bath blue. This decomposition is accompanied by disturbances in the composition of the alloy. To remedy this, one or more reducing agents called "depolarizing agents" are added to the bath, and these make the anodic phenomena more uniform and prevent an oxidation of the complex ions containing the three metals deposited. Soluble alkali metal salts of thiosulphuric and thiomalic acids, of thiocarboxylic acids or else of sulphonated thioalkanes such as, for example, sodium dimethyldithiocarbamatepropylsulphonate can be employed as depolarizing agents.

Lastly, to increase the conductivity of the bath between the electrodes, conductive salts may be added, for example sodium, potassium or ammonium salts of carboxylic, hydroxycarboxylic, amino or aminocarboxylic acids, such as acetic, formic, succinic, tartaric, citric, hydroxyacetic, glycolic, malonic, maleic, mandelic, gluconic or heptonic acids or a mixture thereof.

Furthermore, amino or aminocarboxylic acids and the like may also be added to the bath as complexing agents.

The invention will now be illustrated with reference to the comparative examples and examples which follow.

COMPARATIVE EXAMPLES 1 TO 3

| | |
|---|---|
| Composition of bath A | |
| Gold in the form of $KAu(CN)_2$ | 4 g/l |
| Copper in the form of $K_2Cu(CN)_3$ | 3.5 g/l |
| Zinc in the form of $Zn(CN)_2$ | 10 g/l |
| Sodium hydroxyethyliminodiacetate ("Heida Na2") | 55 g/l |
| Sodium cocoamphopropionate (10% sol.) (wetting agent) | 3 ml/l |
| Tellurium (in the form of Na tellurite) | 7.5 mg |
| Composition of bath B | |
| Gold in the form of $KAu(CH)_2$ | 4 g/l |
| Copper in the form of CuCM | 17 g/l |
| Zinc in the form of $An(CN)_2$ | 10 g/l |
| Potassium cyanide | 41.6 g/l |
| "Heida" (as A) | 55 g/l |
| Wetting agent (as A) | 3 ml/l |

-continued

| | |
|---|---|
| Tellurium (in the form of Na tellurite) | 7.5 mg/l |

The two electrolytic baths according to the invention and described above have been used to deposit a coating of Au-Cu-Zn alloy onto small polished brass plaques, this being done with a bath temperature of 60° C. and using a current density of 1 A/dm$^2$ (Test No. 1), 2 A/dm$^2$ (Test No. 2) and 0.5 A/dm$^2$ (Test No. 3). The results obtained are shown in Table I below, together with that obtained with the comparison test, which was carried out with a bath similar to bath A, but containing no tellurium.

TABLE I

| Test No. | Bath | Alloy composition Au (%) | Cu (%) | Zn (%) | Alloy assay (carats) |
|---|---|---|---|---|---|
| 1 | A | 86.9 | 5.3 | 7.8 | 20.8 |
| 2 | A | 73.3 | 11.8 | 14.9 | 17.6 |
| 3 | B | 65.0 | 34.0 | 1.0 | 15.6 |
| Comparison | A (without Te) | 60.2 | 28.0 | 11.8 | 14.5 |

The alloy deposits obtained as Tests No. 1 and 2 were yellow in colour, bright and perfectly uniform; they were not attacked by dilute nitric acid.

The alloy deposit from Test No. 3 was pink in colour, bright and uniform; it, too, withstood the nitric acid test.

On the other hand, the alloy deposit obtained by using the "comparison" bath, that is to say without tellurium, was nonuniform and, above all, did not stand up to the nitric acid test.

Furthermore, another bath was prepared, corresponding to that of Example 4 of U.S. Pat. No. 4,358,351, without the addition of a tellurium or bismuth salt. The deposits obtained with this bath in the conditions indicated in the abovementioned example, yellow in colour (18 carats), did not stand up to the nitric acid test either.

COMPARATIVE EXAMPLES 4 TO 9

A number of baths were prepared, having the base composition shown below and to which various additives were added, in accordance with the invention, as shown in Table II.

| Composition of bath C | |
|---|---|
| Gold in the form of $KAu(CN)_2$ | 4 g/l |
| Cut in the form of $K_2Cu(CN)_3$ | 14 g/l |
| Zn in the form of $K_2Zn(CN)_4$ | 6.5 g/l |
| Zn in the form of Na hydroxyethyliminodiacetate | 3.5 g/l |
| Na K tartrate | 80 g/l |
| Wetting agent (Na cocoamphocarboxypropionate) | 4 ml/l |
| pH | 10 |

The various baths thus prepared were then used to deposit a coating of Au-Cu-Zn alloy onto small polished brass plaques. The deposition conditions were as follows: stainless steel anode; bath temperature 60° C. (except for Test No. 8: 45° C. and Test No. 9: 80° C.); current density: 0.5 A/dm$^2$ (except for Test No. 4: 0.75 A/dm$^2$ and Test No. 9: 1 A/dm$^2$). The composition of the corresponding alloys obtained is mentioned in Table II.

TABLE II

| Test No. | Additive Element | Additive Quant. (mg/l) | Alloy composition Au (%) | Cu (%) | Zn (%) |
|---|---|---|---|---|---|
| 4 | Bi | 10 | 73.9 | 24.5 | 1.6 |
| 5 | Te | 7.5 | 73.0 | 24.5 | 2.5 |
| 6 | Bi<br>Te | 7.5<br>7.5 | 77.4 | 19.5 | 3.1 |
| 7 | Bi<br>As | 7.5<br>120 | 79.7 | 16.9 | 3.4 |
| 8 | Bi<br>As | 7.5<br>120 | 56.6 | 39.0 | 4.4 |
| 9 | Bi<br>As | 7.5<br>120 | 85.3 | 13.5 | 1.2 |

The Bi was introduced into the above baths in the form of Bi Na hydroxyethyliminodiacetate, while the Te was introduced in the form of K tellurite and the As in the form of $NaAsO_2$.

The small plaques coated with the Au-Cu-Zn deposit were then subjected to the nitric acid test. All the alloys obtained and such as mentioned in Table II above withstood this test, as did other tests carried out with the same baths, but using different conditions, particularly with current densities between 0.1 and 2 A/dm$^2$. The three tests carried out with the Bi+As mixture as additive were intended to demonstrate that the presence of an unfavourable element, namely As, could not validly oppose the beneficial effect of Bi on the formation of a crystalline texture resistant to nitric acid.

By way of comparison, the same bath C as that described above was used with additives other than those provided in the case of the present invention, namely, on the one hand, Se in the form of $H_2SeO_3$ and on the other hand, As in the form of $NaAsO_3$. Numerous test have been carried out with Se quantities of 0.3 and 0.9 g/l, or As quantities of 7.5 to 200 mg/l, this being done for current densities from 0.1 to 2 A/dm$^2$. None of the Au-Cu-Zn alloys obtained with such baths have been able to stand up to the nitric acid test, in contrast to those carried out with baths containing the additives in accordance with the present invention.

EXAMPLES 10 TO 14

By way of additional examples, the following five other electrolytic baths according to the invention have been prepared and used for depositing Au-Cu-Zn coatings. The corresponding compositions of the alloys thus obtained are mentioned in Table III below.

| | |
|---|---|
| - Composition of bath D | |
| Au in the form of $KAu(CN)_2$ | 4.0 g/l |
| Cu in the form of $K_2Cu(CN)_3$ | 11.0 g/l |
| Zn in the form of $K_2Zn(CN)_4$ | 1.0 g/l |
| Tellurium in the form of K tellurite | 7.5 mg/l |
| KCN | 2.5 g/l |
| Na K tartrate | 100 g/l |
| 40% bis(2-hydroxyethyl)laurylamine oxide (wetting agent) | 1 ml/l |
| pH | 9.5 |
| (Conditions of use: 60°C. - 0.5 A/dm$^2$) | |
| - Composition of bath E | |
| Au in the form of $KAu(CN)_2$ | 4.0 g/l |
| Cu in the form of $K_2Cu(CN)_3$ | 14.0 g/l |
| Zn in the form of $K_2Zn(CN)_4$ | 5.0 g/l |
| Zn in the form of K Zn hydroxyethyl-iminodiacetate | 5.0 g/l |

-continued

| | |
|---|---|
| Tellurium in the form of telluric acid | 555 mg/l |
| Na K tartrate | 80 g/l |
| Na N-laurylsarcosinate | 0.1 g/l |
| pH | 10.0 |
| (Conditions of use 60° C. - 0.5 A/dm$^2$) | |
| - Composition of bath F | |
| Au in the form of $KAu(CN)_2$ | 4.0 g/l |
| Cu in the form of $K_2Cu(CN)_3$ | 3.6 g/l |
| Zn in the form of $K_2Zn(CN)_4$ | 6.5 g/l |
| Zn in the form of Zn K hydroxyethyl-iminodiacetate | 3.5 g/l |
| Te in the form of K tellurite | 7.5 mg/l |
| 30% dimethyllaurylamine oxide (wetting agent) | 2 ml/l |
| pH | 10.0 |
| (Conditions of use: 60° C. - 2A/dm$^2$) | |
| - Composition of bath G | |
| Au in the form of $KAu(CN)_2$ | 4.0 g/l |
| Cu in the form of $K_2Cu(CN)_3$ | 7.7 g/l |
| Zn in the form of $K_2Zn(CN)_4$ | 6.0 g/l |
| Zn in the form of Zn glutamate | 4.0 g/l |
| Te in the form of K tellurite | 7.5 mg/l |
| 35% amidocropyldimthyllaurylamine oxide | 1 ml/l |
| (Conditions of use: 60° C. - 0.75 A/dm$^2$) | |
| - Composition of bath H | |
| Au in the form of $KAu(CN)_2$ | 4.0 g/l |
| Cu in the form of $K_2Cu(CN)_3$ | 21.0 g/l |
| Zn in the form of $K_2Zn(CN)_4$ | 6.0 g/l |
| Zn in the form of K Zn hydroxyethylimino-diacetate | 4.0 g/l |
| Bi in the form of Bi K hydroxyethylimino-diacetate | 10 m/l |
| Na K tartrate | 80 g/l |
| Amidopropyldimethyllaurylamine oxide (wetting agent) | 1 ml/l |
| pH | 10.0 |
| (Conditions of use: 60° C. - 0.75 A/dm$^2$) | |

Shown in Table III below are, in addition to the composition of the alloy obtained, its assay and its appearance.

The Au-Cu-Zn deposits obtained in these Tests 10 to 14 were also subjected to the nitric acid test, and all withstood it.

| Test No. | Bath | Alloy obtained Composition Au (%) | Cu (%) | Zn (%) | Assay (carrats) | Appearance |
|---|---|---|---|---|---|---|
| 10 | D | 67.3 | 30.5 | 2.2 | 16.2 | pink - bright |
| 11 | E | 71.2 | 25.5 | 3.3 | 17.1 | pink - bright |
| 12 | F | 73.3 | 11.8 | 14.9 | 17.6 | yellow - bright |
| 13 | G | 61.4 | 32.0 | 6.6 | 14.7 | pink - bright |
| 14 | H | 70.8 | 27.2 | 2.0 | 17.0 | pink - bright |

EXAMPLE 15

A further aqueous bath (Bath I) according to this invention for the electrolytic deposition of a Au-Cu-Zn alloy has the following formulation:

| | |
|---|---|
| Au, in the form of $KAu(CN)_2$ | 4.0 g/l |
| Cu, in the form of CuCN | 20 g/l |
| KCN | 30 g/l |
| Zn, in the form of $Zn(CN)_2$ | 9.5 g/l |
| HEIDA $Na_2$ | 24 g/l |
| Rochelle salt | 60 g/l |
| Aminoxide WS 35 wetting agent | 1 cc/l |
| Solution containing 1.5 g/l of potassium tellurite | 20 ml/l |

Suitable operating conditions are a temperature of 55° to 60° C. and a current density of 0.2 to 1 A/dm$^2$. At 0.8 A/dm$^2$ a deposit of 1 micron was obtained in 5 minutes.

It will be seen that the incorporation of a water-soluble salt of Te or Bi, or a mixture of such salts, to an electrolytic bath containing a cyanide complex of gold, a cyanide complex of copper and a cyanide complex of zinc (the term "cyanide complex" includes, e.g. the cyanides as well as the alkali metal cyanides of the said metals) in accordance with this invention can impart excellent corrosion resistance to the Au-Cu-Zn alloy deposited therefrom, even at low carat values, e.g. 16–18 carats. Unexpectedly, tests have indicated that the Te is codeposited with the alloy metals.

A part of the zinc may be added as a non-cyanide complex or as a salt of an acid (e.g. as alkali metal zinc hydroxyethyliminodiacetate or zinc glutamate); however, it is possible to add instead the corresponding non-cyanide complexing agent or the corresponding acid or an alkali metal salt thereof (e.g. sodium hydroxyethyliminodiacetate) to the bath.

It will of course be understood that the present invention has been described above purely by way of example, and modifications of detail can be made within the scope of the invention.

I claim:

1. A bath for electrolytic deposition of a gold-copper-zinc alloy consisting essentially of cyanide complexes of gold, of copper, and of zinc respectively, at least one surface-active agent, and at least one of a soluble tellurium and a soluble bismuth salt.

2. A bath according to claim 1, characterized in that it contains one or both of a non-cyanide organic complex of zinc and a zinc salt of an acid.

3. A bath according to claim 2, characterized in that the non-cyanide organic compound of zinc is chosen from the group consisting of the sodium, potassium, ammonium and amine salts of one or more of the following aminocarboxylic acids: glycine, alanine, glycylglycine, glycylalanine, asparagine, histidine, leucine, methionine, phenylalanine, valine and hydroxymethyliminodiacetic, hydroxyethyliminodiacetic, hydroxypropyliminodiacetic, hydroxybutyliminodiacetic, nitrilotriacetic, oxycarbonylethyliminodiacetic and N,N-bis(carboxymethyl)aspartic acids.

4. A bath according to claim 1 or claim 2, characterized in that it additionally contains one or more of a conductive salt, a depolarizing agent, and an alkali metal or ammonium cyanide.

5. A bath according to claim 4, characterized in that the depolarizing agent is an alkali metal salt of an acid selected from the group consisting of thiosulphuric acid, thiomalic acid, thiocarboxylic acids and a sulphonated thioalkane.

6. A bath according to claim 5, characterized in that the sulfonated thioalkane comprises sodium dimethyldithiocarbamatethiopropylsuphonate.

7. A bath according to claim 4, characterized in that the conductive salts are selected from the group consisting of sodium, potassium and ammonium salts of carboxylic, hydroxycarboxylic, amino and aminocarboxylic acids and mixtures thereof.

8. A bath according to claim 7 wherein the conductive salts are salts of acids selected from the group consisting of one or more of acetic, formic, succinic, tartaric, citric, hydroxyacetic, glycolic, malonic, maleic, mandelic, gluconic, and heptonic acids.

9. A bath according to claim 1, characterized in that the soluble tellurium salt and soluble bismuth salt comprise one or more of an alkali metal salt, an ammonium salt, and an amine salt.

10. A bath according to claim 1, characterized in that the soluble tellurium salt and soluble bismuth salt comprise one or more of a complex salt with a carboxylic acid, a complex salt with an amino acid and a complex salt with an aminocarboxylic acid.

11. A bath according to claim 1, characterized in that the surface-active agent is chosen from the compounds of formula

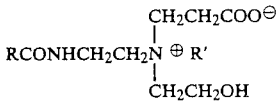

where R is a $C_8$ to $C_{20}$ alkyl group and R′ is a hydrogen atom or a $CH_2COOH$ residue, or else from amidopropyldimethylamino oxides of saturated fatty acids, dimethylamino oxides of saturated fatty acids, dimethylalkylamino oxides, and bis(2-hydroxyethyl)alkylamino oxides whose molecule contains a carbon chain of 11 to 20 atoms.

12. A bath according to claim 1, characterized in that it contains:

- from 0.5 to 20 g/l of gold in the form of cyanide complex
- from 0.1 to 30 g/l of copper in the form of cyanide complex
- from 0.1 to 50 g/l of zinc in the form of cyanide complex
- from 1 to 100 mg/l of Te and/or of Bi in the form of a soluble salt ($Te^{+4}$, $Bi^{+3}$) (from 200 to 2,000 mg/l if the Te is in hexavalent form)
- from 0.1 to 20 ml/l of surface-active agents
- from 0.1 to 50 g/l of zinc in the form of an organic complex other than cyanide or of an acid salt
- from 0 to 10 g/l of depolarizing agent
- from 0 to 100 g/l of conductive salts, and
- from 0 to 10 g/l of alkali metal or ammonium cyanide and that it has a pH of 7 to 12.

* * * * *